US010964450B2

(12) United States Patent
De Rai et al.

(10) Patent No.: US 10,964,450 B2
(45) Date of Patent: Mar. 30, 2021

(54) POWER CABLE WITH ENHANCED AMPACITY

(71) Applicant: Prysmian S.p.A., Milan (IT)

(72) Inventors: Luca Giorgio Maria De Rai, Milan (IT); Michelangelo Graziano, Milan (IT)

(73) Assignee: PRYSMIAN S.P.A., Milan (IT)

( * ) Notice: Subject to any disclaimer, the term of this patent is extended or adjusted under 35 U.S.C. 154(b) by 0 days.

(21) Appl. No.: 16/880,822

(22) Filed: May 21, 2020

(65) Prior Publication Data

US 2020/0373038 A1 Nov. 26, 2020

(30) Foreign Application Priority Data

May 23, 2019 (IT) ..... 102019000007142

(51) Int. Cl.
*H01B 7/42* (2006.01)

(52) U.S. Cl.
CPC ..... *H01B 7/423* (2013.01)

(58) Field of Classification Search
CPC ..... H01B 7/423
USPC ..... 174/15.6
See application file for complete search history.

(56) References Cited

U.S. PATENT DOCUMENTS 3,949,154 A * 4/1976 Rasquin ..... H01B 7/29 174/15.6
3,962,529 A 6/1976 Kubo
4,523,648 A * 6/1985 Strada ..... H01B 9/0616 174/26 R
5,412,304 A * 5/1995 Abbott ..... H02J 50/90 320/108
5,591,937 A * 1/1997 Woody ..... B60L 53/302 174/5 R
8,957,312 B2 * 2/2015 McCullough ..... H01B 9/006 174/113 R
9,287,646 B2 * 3/2016 Mark ..... H02J 7/0042
2002/0153162 A1 10/2002 Spreafico
2013/0269966 A1 * 10/2013 Emme ..... H01B 7/423 174/15.6
2014/0221213 A1 * 8/2014 Fukuda ..... H02G 15/34 505/163
2017/0144558 A1 * 5/2017 Remisch ..... H01R 13/005
2019/0237218 A1 * 8/2019 Heyne ..... B60L 53/302

FOREIGN PATENT DOCUMENTS

GB 2350474 A 11/2000

* cited by examiner

*Primary Examiner* — Timothy J Thompson
*Assistant Examiner* — Michael F McAllister
(74) *Attorney, Agent, or Firm* — Slater Matsil, LLP

(57) ABSTRACT

A power cable includes an electric conductor; an electrical insulation layer surrounding the electrical conductor; a cooling system including a cooling duct substantially parallel to the electrical conductor along a power cable longitudinal axis and configured to flow a cooling fluid; a carbon allotrope layer in direct contact with the electrical conductor, where the carbon allotrope layer is provided between the electric conductor and the cooling duct; and a cable jacket enclosing the electric conductor, the electrical insulation layer, and the cooling system.

19 Claims, 2 Drawing Sheets

POWER CABLE WITH ENHANCED AMPACITY

CROSS-REFERENCE TO RELATED APPLICATIONS

This application claims the benefit of Italian Patent Application No. 102019000007142 filed on May 23, 2019, which application is hereby incorporated herein by reference.

TECHNICAL FIELD

The present disclosure relates to the technical field of power cables.

BACKGROUND

Ampacity (also described as current-carrying capacity) is defined as the maximum current, in amperes, that an electrical conductor can carry continuously under the conditions of use without exceeding its temperature rating.

The ampacity of an electrical conductor depends on its ability to dissipate heat without damage to the electrical conductor or its electrical insulation. This ability to dissipate heat is a function of the temperature rating of the cable electrical insulation material, the electrical resistance of the electrical conductor material, the ambient temperature.

Most power cable is sized according to its ampacity. Excessive current can cause overheating, insulation damage and fire/shock hazards that, in turn, can harm equipment through heat buildup and produce cable faults that lead to lost productivity.

An emerging application of power cables is in the field of electrical vehicles (EV), which are expected to nearly replace, in the next years, traditional vehicles powered by internal combustion engines.

Since the EV market is becoming a reality, a lot of services accessories to the common use of such vehicles need to be developed to satisfy the users. A critical aspect is charging the EV batteries: in this context, the availability of EV batteries charging stations that allow time saving for a (complete or partial) battery charge cycle is essential.

To make an EV battery charge faster, a possibility is to increase the power of the charging stations and the energy transferred through power cables. Nowadays, charging stations can have a power higher than 350 kW.

Electrical power P is, as known, defined by Ohm's law as $P=RI^2=VI$, where R denotes the electrical resistance of an electrical conductor, I denotes the electrical current flowing through the electrical conductor and V denotes the electrical potential difference between two ends of the electrical conductor (voltage).

Since the electrical resistance is a material-dependent parameter, affected by resistivity and the geometry of the system, to increase the voltage means, in short, increasing the cross-section of the electrical conductor, resulting in a power cable which is significantly heavy and difficult to handle. However, light weight and ease of handling are seen as essential for power cables for EV batteries charging stations.

Another possibility to increase the electrical power delivered by an electrical conductor is to increase the current rate. This, as known by Joule's law, results in a significant increase of temperature by Joule's effect.

To overcome this issue, power cable cooling systems have been proposed to attenuate rising temperature in the power cable, affecting, inter alia, the properties of the insulation around it.

U.S. Pat. No. 9,449,739 discloses a power cable apparatus that comprises an elongated thermal conductor, and an electrical conductor layer surrounding at least a portion of the elongated thermal conductor. Heat generated in the power cable is transferred via the elongated thermal conductor to at least one end of the power cable which is connected to a cooling system. The apparatus further comprises an electric insulation layer surrounding at least a portion of the electrical conductor layer. The apparatus further comprises a thermal insulation layer surrounding at least a portion of the electric insulation layer. A second thermal conductor can surround the electrical conductor. An electric insulation layer surrounds the second thermal conductor. The thermal conductor is manufactured from pyrolytic graphite or carbon nanotubes (CNTs).

SUMMARY

In one embodiment, a power cable includes an electric conductor; an electrical insulation layer surrounding the electrical conductor; a cooling system including a cooling duct substantially parallel to the electrical conductor along a power cable longitudinal axis and configured to flow a cooling fluid; a carbon allotrope layer in direct contact with the electrical conductor, where the carbon allotrope layer is provided between the electric conductor and the cooling duct; and a cable jacket enclosing the electric conductor, the electrical insulation layer, and the cooling system.

In one embodiment, a power cable includes a first cooling duct disposed along a longitudinal axis of the power cable, the first cooling duct configured to flow a cooling fluid; a first electrically conductive layer including a first plurality of conductive wires wound around the first cooling duct; first carbon allotrope layers covering the first plurality of conductive wires; a first electrical insulation layer surrounding the first electrically conductive layer; and a cable jacket enclosing the first electrical insulation layer.

In one embodiment, a power cable includes an electrical conductor disposed along a longitudinal axis of the power cable; a carbon allotrope layer covering the electrical conductor; an electrical insulation layer surrounding the carbon allotrope layer; a plurality of cooling ducts forming a cooling system surrounding the carbon allotrope layer, the plurality of cooling ducts configured to flow a cooling fluid; and an outer jacket surrounding the electrical insulation layer and the cooling system.

BRIEF DESCRIPTION OF THE DRAWINGS

The features and advantages of a power cable according to the present disclosure will be made even clearer by the following detailed description of exemplary and non-limitative embodiments. For its better intelligibility, the following detailed description should preferably be read making reference to the attached drawings, wherein.

DETAILED DESCRIPTION OF ILLUSTRATIVE EMBODIMENTS

Figure 1A:
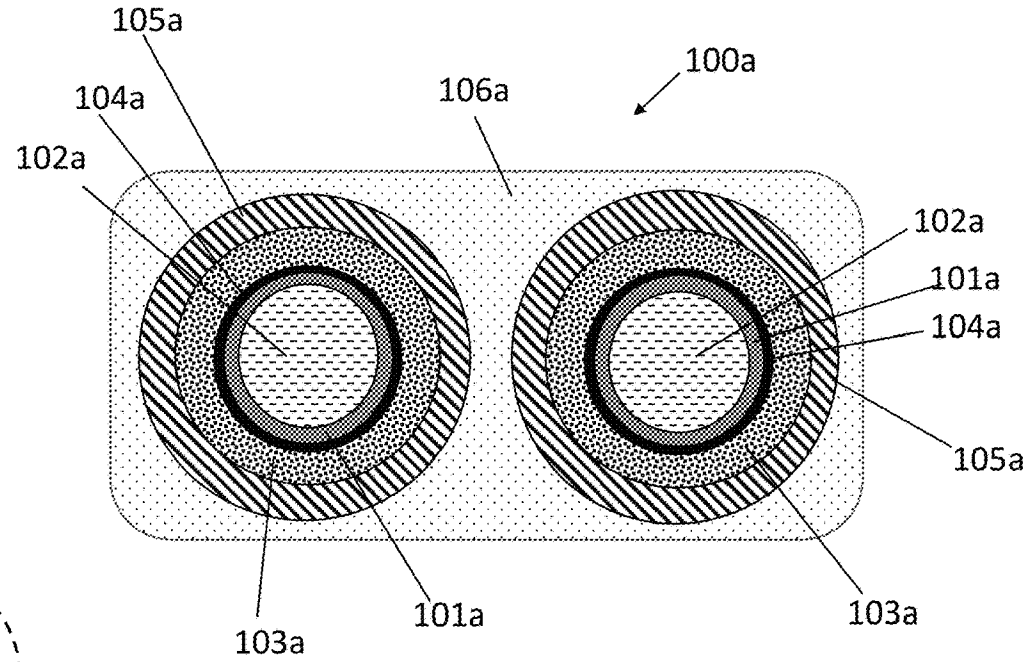
FIG. 1A shows a cable according to the embodiment of FIG. 1 including two electrical conductors.

The Applicant has perceived that there is a strong need for power cables featuring increased ampacity. Such a need is particularly felt in the field of power cables for EV batteries charging stations: these power cables, in addition to high ampacity, should at the same time feature light weight and be easy to handle.

In respect of U.S. Pat. No. 9,449,739, the Applicant has observed that the transfer of the heat generated in the power cable via the elongated thermal conductor to at least one end of the power cable which is connected to a cooling system is not efficient, because the heat dissipation occurs longitudinally along the cable and the cooling system is located just at the end of the cable and not along the cable length.

Embodiments of the present disclosure provide a power cable which is more efficiently cooled during operation.

Power cables endowed of a cooling system comprising a cooling duct extended along the electric conductor within a common cable jacket are known in the art. See, for example, WO 2018/104234 and WO 2015/119791. The addition of a cooling duct within the cable jacket increases the cable diameter. As the mass flow rate of the cooling fluid is to be suitable for attaining a suitable cooling of the electric conductor, the just mentioned patent applications, relating to power cables for EV charging, provides for a plurality of cooling ducts resulting in a complex cable structure and, accordingly, a complex manufacturing and cable cost increasing.

The Applicant found that the cooling efficiency of a cooling system for power cable comprising a cooling duct extended along the electric conductor within a common cable jacket could be increased by providing the power cable with a layer of carbon allotrope extended along the electric conductor, in direct contact thereto and interposed between the electric conductor and the cooling system.

According to the present disclosure, a power cable is provided comprising a cable jacket enclosing: an electric conductor; an electrical insulation layer surrounding the electrical conductor; a cooling system comprising a cooling duct substantially parallel to the electrical conductor along a power cable longitudinal axis and designed to be, in use, run through by a cooling fluid; and a carbon allotrope layer in direct contact with the electrical conductor; wherein the carbon allotrope layer is provided between the electric conductor and the cooling duct.

In an embodiment, the cooling duct is provided in a radial inner position with respect to the electrical conductor and at least partially in direct contact with a carbon allotrope layer. In this case, the electrical insulation layer is in contact with the electric conductor, with a carbon allotrope layer optionally interposed.

In another embodiment, the cooling duct is provided in a radial outer position with respect to the electrical conductor. In this embodiment, the cooling duct can be in form of a plurality of cooling tubes.

When the cooling duct is provided in a radial outer position with respect to the electrical conductor, the cooling duct can be in a radial inner position with respect to the electrical insulation layer, thus separating the electrical insulation layer from the electrical conductor. In this case, the cooling duct is at least partially in direct contact with a carbon allotrope layer.

Alternatively, when the cooling duct is provided in a radial outer position with respect to the electrical conductor, the cooling duct can be in a radial outer position with respect to the electrical insulation layer, too. In this case, the electrical insulation layer is in contact with the electric conductor, with a carbon allotrope layer optionally interposed, and separates the cooling duct from the electric conductor and the carbon allotrope layer.

The power cable of the present disclosure can comprise a plurality of electric conductors, for example from two to four electric conductors.

The carbon allotrope layer can be, for example, a layer of graphene, of graphite (e.g. pyrolytic graphite) or a layer of carbon nanotubes (CNTs). Graphene is an allotrope (form) of carbon consisting of a single layer of carbon atoms arranged in a hexagonal lattice. Carbon nanotubes (CNTs) are allotropes of carbon with a cylindrical nanostructure.

The carbon allotrope layer can have a thickness of some microns, for example a thickness in the range from 5 μm to 100 μm.

The provision of the carbon allotrope layer interposed between the conductor and the cooling system enhances the transmission of heat from the electrical conductor to the cooling system. Thus, the provision of the carbon allotrope layer helps, in use, the cooling of the electrical conductor of the power cable and thus allows higher electrical current flow without the risk of exceeding the temperature ratings. Thanks to this, the provision of the carbon allotrope layer improves the power cable ampacity, i.e. the maximum current that the cable conductor can carry continuously under the conditions of use without exceeding its temperature rating. The performance of the power cable is consequently increased.

For the purpose of the present description and of the appended claims, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

For the purpose of the present description and of the appended claims, the words "a" or "an" should be read to include one or at least one and the singular also includes the plural unless it is obvious that it is meant otherwise. This is done merely for convenience and to give a general sense of the invention.

The present disclosure, in at least one of the aforementioned aspects, can be implemented according to one or more of the following embodiments, optionally combined together.

The preceding summary is to provide an understanding of some aspects of the disclosure. As will be appreciated, other embodiments of the disclosure are possible utilizing, alone or in combination, one or more of the features set forth above or described in detail below.

The present disclosure relates to a power cable comprising a cable jacket enclosing at least one electrical conductor, an electrical insulation layer, a carbon allotrope layer and a cooling system comprising at least one duct substantially parallel to the electrical conductor along the cable length and designed to be, in use, run through by a cooling fluid.

As cooling fluid glycol or glycol mixture employed in air-cooling system can be used.

The electrical conductor is in direct contact with the carbon allotrope layer. The carbon allotrope layer is interposed between the conductor and at least one duct of the cooling system.

Figure 1:
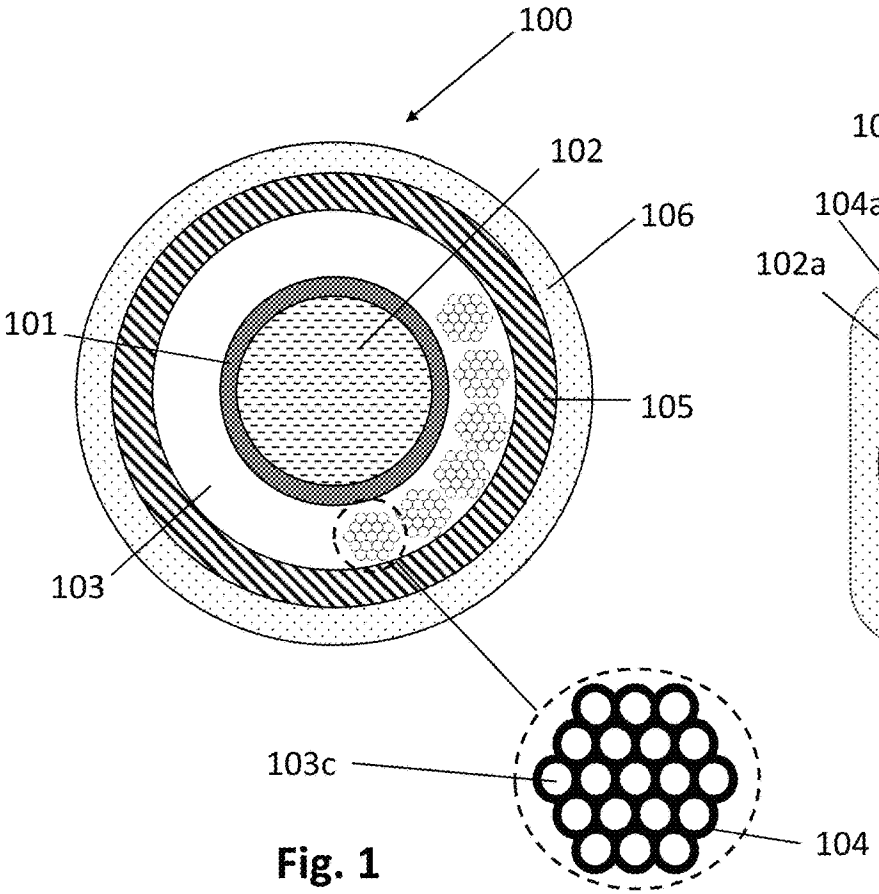
FIG. 1 shows, in a cross-section transversal to a longitudinal axis, a power cable according to an embodiment of the present disclosure.
Figure 3:
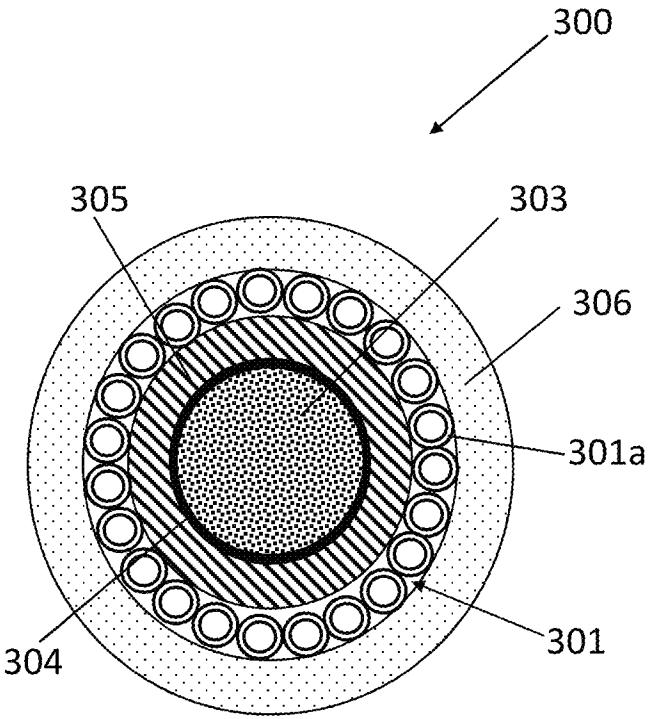
FIG. 3 shows, in a cross-section transversal to a longitudinal axis, a power cable according to still another embodiment of the present disclosure.
Figure 2:
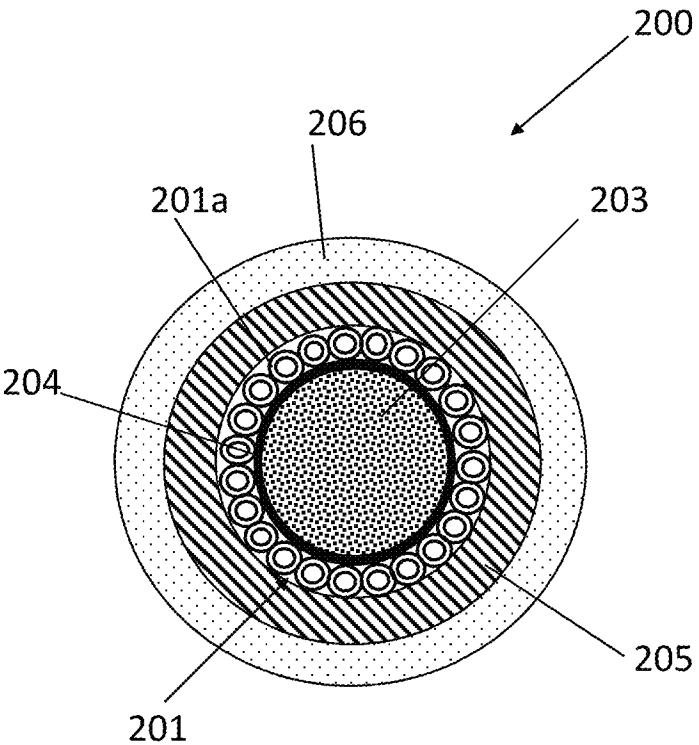
FIG. 2 shows, in a cross-section transversal to a longitudinal axis, a power cable according to another embodiment of the present disclosure.

The at least one cooling duct can be provided: a) in a radial inner position with respect to the conductor, as in the embodiment depicted in FIG. 1 and FIG. 1A, or, alternatively b) in a radial outer position with respect to the electrical conductor and in a radial inner position with respect to the electrical insulation layer, as in the embodiment depicted in FIG. 2, and/or c) in a radial outer position with respect to the electrical insulation layer, as in the embodiment depicted in FIG. 3.

Referring to FIG. 1, an embodiment of a power cable according to the present disclosure is schematically depicted, in a cross-section transversal to the longitudinal axis of the power cable.

The power cable 100 comprises, in radial succession from the innermost part (cable longitudinal axis) towards the outside: a cooling duct 101 that extends along the cable length and that, in use, is intended to be run through by a cooling fluid 102; a carbon allotrope layer 104, an electrical conductor 103; an electrical insulation layer 105 and a cable jacket 106.

The cooling duct 101 is connected, at both ends of the power cable 100, to a cooling fluid circulation system known per se and not shown nor described in greater detail.

The electrical conductor 103 can be in form of threads of stranded wires 103*c* wound around the cooling duct 101 to form an electrically conductive layer. The electrical conductor 103 is made, for example, from copper, aluminum or alloys containing them.

The carbon allotrope layer 104 can for example be made of graphene or a layer of carbon nanotubes (CNTs).

The carbon allotrope layer 104 can be a layer applied onto each wire 103*c* strand of the electrical conductor 103 by means of a Chemical Vapor Deposition (CVD) process, or as a paint. The application of the carbon allotrope layer 104 can be before or after the wires 103*c* are stranded, in the latter case the application by paint being selected.

Alternatively, or in addition, the carbon allotrope layer 104 can be applied to the outer surface of the cooling duct 101.

An electrical insulation layer 105 surrounds, in direct contact with, the electrical conductor 103. The electrical insulation layer 105 is made, for example, of optionally crosslinked polyethylene, of ethylene propylene rubber (EPR) or of polyvinylchloride (PVC).

The cable jacket 106 can be made, for example, of PVC, polyurethane or polyethylene.

The power cable of the present disclosure can include more than one electrical conductor, e.g. two, three or four electrical conductors. FIG. 1A depicts an example of a power cable 100*a*, which is a flat cable, comprising two electrical conductors 103*a*. In such a case, each electrical conductor 103*a* may surround a respective cooling duct 101*a*, with the interposition of a carbon allotrope layer 104*a*. For clarity sake, both the conductors 103*a* and the carbon allotrope layer 104*a* are schematically depicted, but they are meant to have structure and arrangement as described in connection with FIG. 1.

Each electrical conductor 103*a* is surrounded by a respective electrical insulation layer 105*a*. All the electrically insulated electrical conductors 103*a*, 105*a* are surrounded by a cable jacket 106*a*. The materials and forms of cable 100*a* components are analogous to those of cable 100.

FIG. 2 schematically depicts another embodiment of a power cable according to the present disclosure, in a cross-section transversal to the longitudinal axis of the power cable.

In this embodiment the power cable 200 comprises, in radial succession from the innermost part towards the outside: an electrical conductor 203 surrounded by a carbon allotrope layer 204 (also in this case, both the electrical conductor 203 and the carbon allotrope layer 204 are schematically depicted for clarity sake, but they are meant to have structure and arrangement as described in connection with FIG. 1), a cooling duct 201 that, in use, is intended to be run through a cooling fluid (not shown, for clarity sake), an electrical insulation layer 205 and a cable jacket 206.

The electrical conductor 203 can be in form of a solid rod or of threads of stranded wires (as depicted in FIG. 1). The electrical conductor 203, either solid or in strands, is made, for example, of copper, aluminum alloys containing them. In case the electrical conductor 203 is a single solid conductor, the layer 204 of carbon allotrope is applied peripherally to the solid conductor 203, to the external surface thereof.

The cooling duct 201 is in form of a plurality of cooling tubes 201*a* circumferentially stranded around the electrical conductor 203 to form a layer. As in the embodiment of FIG. 1, the cooling duct 201 is connected, at both ends of the power cable 200, to a cooling fluid circulation system known per se and not shown nor described in greater detail.

The cooling duct 201 is surrounded by an electrically insulation layer 205 which, in turn, is surrounded by a cable jacket 206.

A power cable with the configuration of cable 200 can include more than one electrical conductor, e.g. two or three electrical conductors. In such a case, each electrical conductor can be surrounded by a respective cooling duct like the cooling duct 201, with the interposition of a carbon allotrope layer. Each plurality of cooling ducts is surrounded by a respective electrical insulation layer. All the electrical insulation layers are surrounded by a single cable jacket like the cable jacket 206.

FIG. 3 schematically depicts still another embodiment of a power cable according to the present disclosure, in a cross-section transversal to the longitudinal axis of the power cable.

In this embodiment the power cable 300 comprises, in radial succession from the innermost part towards the outside: an electrical conductor 303 surrounded by a carbon allotrope layer 304 (also in this case, both the conductors 203 and the carbon allotrope layer 204 are schematically depicted for clarity sake, but they are meant to have structure and arrangement as described in connection with FIG. 1); an electrical insulation layer 305; a cooling duct 301 that, in use, is intended to be run through a cooling fluid (not shown, for clarity sake) and a cable jacket 306.

The electrical conductor 303 and the carbon allotrope layer 304 can have the form and material as described in connection with, respectively, the electrical conductor 203 of FIG. 2 and 103 of FIG. 1 and the carbon allotrope layer 204 of FIG. 2 and 104 of FIG. 1.

The cooling duct 301 is in form of a plurality of cooling tubes 301*a* circumferentially stranded around the electrically insulation layer 305. As in the embodiments of FIGS. 1 and 2, the cooling duct 301 is connected, at end of the power cable 300, to a cooling fluid circulation system known per se and not shown nor described in greater detail.

In an alternative embodiment, not shown, the electrically insulation layer 305 is surrounded by a cooling duct in form of two tubes or layers with different diameters which, in operation, are substantially concentric and run through by a cooling fluid.

A power cable with the configuration of cable 300 can include more than one electrical conductor, e.g. two or three electrical conductors. In such a case, each electrical conductor is surrounded by a respective layer of electrically insulation layer, with the interposition of a carbon allotrope layer. Each electrically insulation layer is surrounded by a respective cooling duct like the cooling duct 301. All the cooling ducts are surrounded by a single cable jacket like the cable jacket 306.

What is claimed is:

1. A power cable comprising:

an electric conductor;

an electrical insulation layer surrounding the electrical conductor;

a cooling system comprising a cooling duct substantially parallel to the electrical conductor along a power cable longitudinal axis and configured to flow a cooling fluid;

a carbon allotrope layer in direct contact with the electrical conductor, wherein the carbon allotrope layer is provided between the electric conductor and the cooling duct, wherein the carbon allotrope layer is a layer made of graphene, graphite, or carbon nanotubes (CNTs); and a cable jacket enclosing the electric conductor, the electrical insulation layer, and the cooling system.

2. The power cable of claim 1, wherein the cooling duct is provided in a radial inner position with respect to the electrical conductor.

3. The power cable of claim 1, wherein the cooling duct is provided in a radial outer position with respect to the electrical conductor.

4. The power cable of claim 3, wherein the cooling duct is in form of a plurality of cooling tubes.

5. The power cable of claim 3, wherein the cooling duct is provided in a radial inner position with respect to the electrical insulation layer and separates the electrically insulation layer from the electrical conductor.

6. The power cable of claim 1, wherein the electrical conductor comprises a single solid conductor.

7. The power cable of claim 1, wherein the electrical conductor comprises threads of stranded wires.

8. The power cable of claim 1, further comprising a plurality of electric conductors.

9. A power cable comprising:

a first cooling duct disposed along a longitudinal axis of the power cable, the first cooling duct configured to flow a cooling fluid;

a first electrically conductive layer comprising a first plurality of conductive wires wound around the first cooling duct;

first carbon allotrope layers covering the first plurality of conductive wires;

a first electrical insulation layer surrounding the first electrically conductive layer; and a cable jacket enclosing the first electrical insulation layer.

10. The power cable of claim 9, further comprising a further carbon allotrope layer covering the first cooling duct.

11. The power cable of claim 9, wherein each of the first carbon allotrope layers is a layer made of graphene, graphite, and carbon nanotubes (CNTs).

12. The power cable of claim 9, further comprising:

a second cooling duct disposed along the longitudinal axis of the power cable, the second cooling duct configured to flow the cooling fluid;

a second electrically conductive layer comprising a second plurality of conductive wires wound around the second cooling duct;

second carbon allotrope layers covering the second plurality of conductive wires;

a second electrical insulation layer surrounding the second electrically conductive layer; and wherein the cable jacket encloses the second electrical insulation layer.

13. The power cable of claim 12, wherein a portion of the cable jacket separates the first electrical insulation layer from the second electrical insulation layer.

14. A power cable comprising:

an electrical conductor disposed along a longitudinal axis of the power cable;

a carbon allotrope layer covering the electrical conductor;

an electrical insulation layer surrounding the carbon allotrope layer;

a plurality of cooling ducts forming a cooling system surrounding the carbon allotrope layer, the plurality of cooling ducts configured to flow a cooling fluid; and an outer jacket surrounding the electrical insulation layer and the cooling system.

15. The power cable of claim 14, wherein the plurality of cooling ducts is disposed between the carbon allotrope layer and the electrical insulation layer.

16. The power cable of claim 14, wherein the electrical insulation layer is disposed between the carbon allotrope layer and the plurality of cooling ducts.

17. The power cable of claim 14, wherein the carbon allotrope layer is a layer made of graphene, graphite, and carbon nanotubes (CNTs).

18. The power cable of claim 14, wherein the electrical conductor comprises a single solid conductor.

19. The power cable of claim 14, wherein the electrical conductor comprises threads of stranded wires.

* * * * *